US006732888B1

(12) United States Patent
Smiley et al.

(10) Patent No.: US 6,732,888 B1
(45) Date of Patent: May 11, 2004

(54) BOTTLE HAVING MULTIPLE OUTLETS

(75) Inventors: Charles F. Smiley, Waunakee, WI (US); Richard G. Diermeier, Waunakee, WI (US); Michael A. Eckstein, Poynette, WI (US)

(73) Assignee: Traex Corporation, Toledo, OH (US)

( * ) Notice: Subject to any disclaimer, the term of this patent is extended or adjusted under 35 U.S.C. 154(b) by 0 days.

(21) Appl. No.: 10/385,075

(22) Filed: Mar. 10, 2003

(51) Int. Cl.[7] ..... B65D 35/00

(52) U.S. Cl. ..... 222/485; 222/129; 222/206; 222/212

(58) Field of Search ..... 222/129, 206, 222/207, 212, 215, 482, 484, 485

(56) References Cited

U.S. PATENT DOCUMENTS 2,802,604 A * 8/1957 Ebberts ..... 222/207
3,591,053 A * 7/1971 Thomas ..... 222/485
4,148,417 A * 4/1979 Simmons ..... 222/94
5,062,550 A * 11/1991 Singh ..... 222/80
5,361,947 A * 11/1994 Lifshey ..... 222/212
5,873,494 A * 2/1999 Dallas, Jr. ..... 222/129
5,921,440 A * 7/1999 Maines ..... 222/145.2

* cited by examiner

*Primary Examiner*—J. Casimer Jacyna
(74) *Attorney, Agent, or Firm*—Emch, Schaffer, Schaub & Porcello Co., L.P.A.

(57) ABSTRACT

A squeeze bottle is provided for dispensing a flowable liquid material. The bottle includes an axially extending squeezable container having a side wall and a base at one end of the side wall to define an interior chamber for housing the flowable liquid material. The container defines a neck that extends axially outwardly from an axially outer end of the container opposite the base. A cap is removably attachable to the neck, and includes a plate having at least one opening therethrough and in communication with the interior void of the container. The cap further includes at least two tips defining respective outlet channels in fluid communication with the plate opening to outlet at least two directed streams from the squeeze bottle to a desired food product.

18 Claims, 5 Drawing Sheets

BOTTLE HAVING MULTIPLE OUTLETS

BACKGROUND OF THE INVENTION

The present invention relates generally to squeeze bottles, and in particular relates to a squeeze bottle for applying flowable liquid materials such as ketchup, mustard and like condiments to a food product in one pass.

Squeeze bottles for applying a condiment to a food product are well known. Generally, such a bottle includes a container made of a plastic or other easily compressible material that houses a given condiment. The container defines a neck portion disposed at one end of the container that is attached to an outlet assembly. A standard outlet assembly includes a cap that is threadedly connected to the neck of the container at one end, and has a single outlet tip that faces outwardly from the container at the other end. During use, the container is inverted and squeezed to dispense the condiment from the tip to a food product as a directed stream.

Conventional tips have a circular cross section and generally are sized to provide the user with flexibility to apply a desired amount of condiment to the food product. The softer squeezing of the container will yield a lower mass flow rate out of the tip. Accordingly, in order to accommodate those who wish to apply only a small amount of condiment to the food product, the tips are generally designed with a small cross section. Those who desire an additional amount of condiment can squeeze harder and, typically, make several passes at the food product. This can be a time consuming and often messy procedure. Further, one squeeze may not provide a sufficient amount of pressure to dispense condiment over the length of time necessary to conduct several passes, thereby necessitating multiple squeezes and a resulting non-uniform volume of dispensed condiment across the food product.

There is a need for an outlet assembly usable in combination with a conventional container that enables one to apply a sufficient and consistent amount of condiment to a food product with one pass.

BRIEF SUMMARY OF THE INVENTION

In accordance with one aspect of the invention, a cap for dispensing a flowable liquid material from an axially extending container is provided. The cap includes a substantially radially extending plate, having at least one opening extending therethrough, and a flange extending axially inwardly from the plate and configured to be connected to an axially outer end of the container. The cap further includes at least two outlets having axially outer ends presenting respective openings that extend axially inwardly through the at least one opening in the plate. The cap is configured to selectively place the openings in communication with the container.

The primary object of the present invention is to provide a bottle having multiple outlets for the application of a sufficient and consistent amount of flowable liquid material from the bottle.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
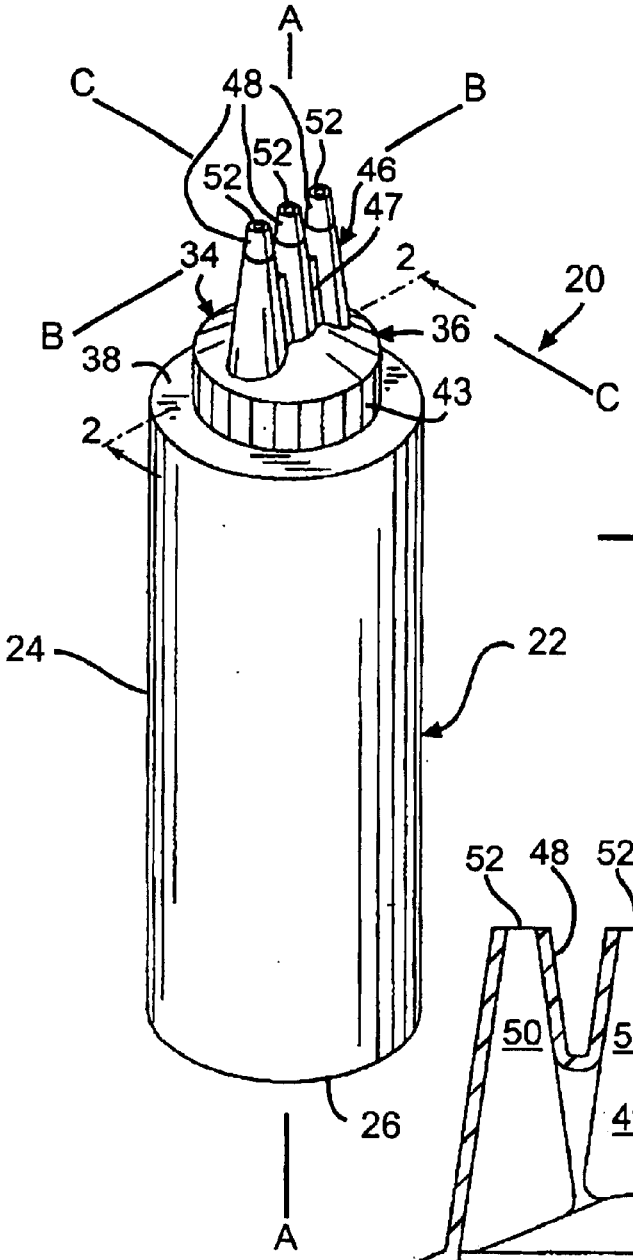
FIG. 1 is a perspective view of a squeeze bottle connected to a cap having multiple outlets constructed in accordance with a preferred embodiment of the present invention.
Figure 2:
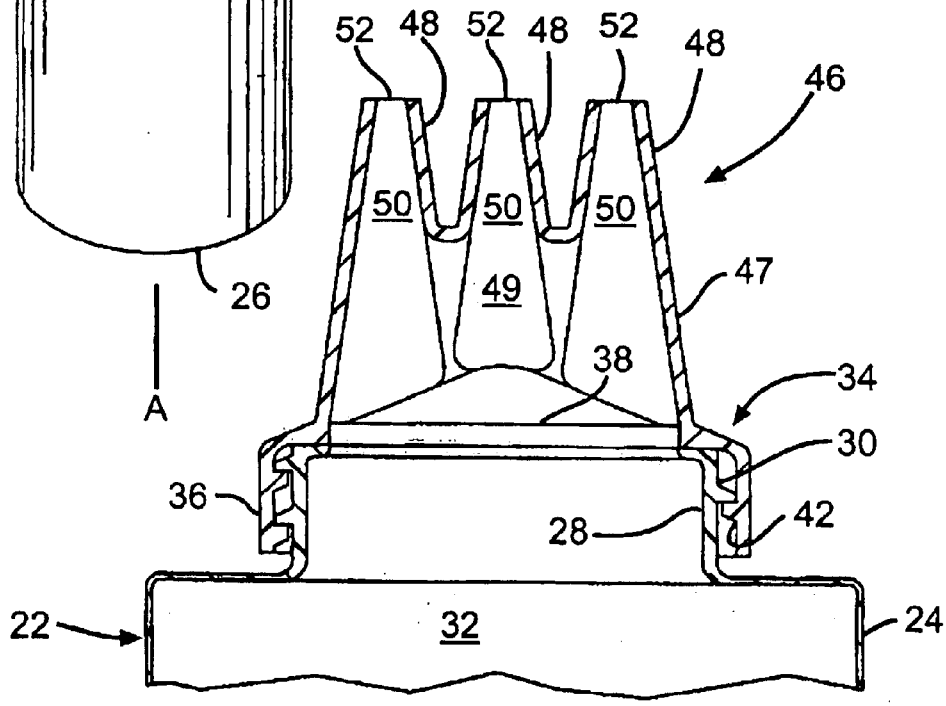
FIG. 2 is a sectional side elevation view of the cap illustrated in FIG. 1 taken along the line 2—2 of FIG. 1.

The preferred embodiments and best mode of the present invention will now be described in detail with reference being made to the drawings. Referring to FIGS. 1 and 2, a squeeze bottle 20 includes an axially extending container 22 having an elongated cylindrical side wall 24 extending axially along axis of extension A—A. A base 26 is disposed at the one axial end of the side wall 24 that seals the bottom of the container 22. A neck 28 is integrally connected to the axially upper end of the container 22, and is defined by a reduced diameter compared to that of side wall 24. Neck 28 includes a threaded outer surface 30. An internal void 32 is thus collectively defined by side wall 24 and base 26 for housing a volume of flowable liquid material. Examples of such flowable liquid material include condiments such as ketchup, mustard, mayonnaise, relish, or the like that may be poured into the neck 28 of container 22.

Container 22 is made of a transparent or translucent plastic such as polypropylene or polyethylene to enable the user to gauge the amount and type of material in the container to determine when the container 22 is to be refilled. Alternatively, the plastic may be color coded to identify the type of material. The plastic is also preferably resilient so as to enable the user to squeeze the container 22 and thus provide an internal pressure suitable to force a directed stream of material out of the container and towards a desired food product. It should be understood that other dispensing methods can be utilized.

A cap 34 is removably connected to the neck 28, and includes a cylindrical flange 36 that extends axially inwardly from the radially outer edge of a substantially radially extending plate 38. The inner surface 42 of flange 36 is threaded and is configured to be removably connected to the container 22 by the threaded outer surface of neck 28 once the container 22 has been filled with the desired material. The radially outer surface 43 of flange 36 is preferably textured to enable a user to easily grip the cap 34 for attaching the cap to, and removing the cap from, container 22. The axially outer surface of plate 38 is integrally connected to an outlet assembly 46.

Outlet assembly 46 comprises an outlet housing 47 that extends axially outwardly from plate 38. The housing 47 defines a housing interior void 49 that extends through plate 38. The housing 47 is integrally connected at its axially outer end to three frusto-conical tip members 48 whose large ends extend from housing 47 such that the tips 48 extend axially outwardly therefrom. In particular, the tips are aligned in a direction B—B that extends transverse to axis of extension A—A. Each tip 48 defines an interior outlet channel 50 having an outlet 52 to the ambient environment at its axially outer end. Each channel 50 has an open inlet that is in fluid communication with void 49, thereby placing each channel 50 in fluid communication with the void 32 of container 22. When the user inverts the container 22 containing a flowable liquid material and directs the tips 48 at a food product and applies a squeezing pressure to container 22, the material will be forced through outlet channels 50 and dispensed as three separate directed streams.

During operation, the container 22 is squeezed and is passed along the food product in a direction along lateral axis C—C that is normal to both axes A—A and B—B. Operating the bottle 20 in such a manner enables the material to be dispensed as three separate streams that are applied uniformly across the food product. The three streams enable a greater volume of material to be applied than was possible using a conventional single-tipped outlet. Accordingly, the need to make multiple passes with the container in order to deliver an adequate amount of a condiment to a food product is greatly reduced or eliminated by the present invention. Because each tip 48 has the same cross section and receives the condiment at generally the same mass flow rate, the condiment being dispensed from cap 34 will be applied more uniformly across the food product in contrast to previous methods whereby flow rates typically vary with each successive pass across the food product. Accordingly, the need to subsequently spread the dispensed condiment across the food product in a later step is also eliminated.

While the multiple tip design of the present invention enables a user to dispense a greater volume of material, the relatively small and circular cross section of each outlet 52 also allows the user to reduce the volume of dispensed material by controlling the amount of squeezing pressure applied to the container 22. The outlets 52 can have varying size cross sections to correspondingly vary the mass flow rate of the dispensed condiment. Accordingly, a sandwich maker could choose from one of several caps having varying outlet cross-sections depending on the volume of condiment that is to be applied to a given food product. A cap (not shown) could further be provided to selectively seal one or more of the tips 48 if desired.

While the cap 34 includes three tips 48 in accordance with the preferred embodiment, it should be appreciated the present invention is intended to encompass a bottle cap having any number of tips (and corresponding outlets) greater than one tip to provide the advantages described above. The present invention further recognizes that the cap need not be used in combination with a squeeze bottle, but instead may be used in combination with any suitable container that houses a flowable liquid material that is to be expelled as a directed stream (or plurality of directed streams). It should be further appreciated that the present invention is related to a container having multiple outlets extending through the container and, accordingly, is not to be limited to the cap 34 illustrated and described herein. For example, the present invention is also intended to cover a cap 34 having more than one aperture extending directly through the plate 34 to provide an outlet from the container 22. These apertures can be connected directly to a dedicated tip that extends axially outwardly directly from the plate 34 rather than through the outlet housing 47 described above.

Figure 3:
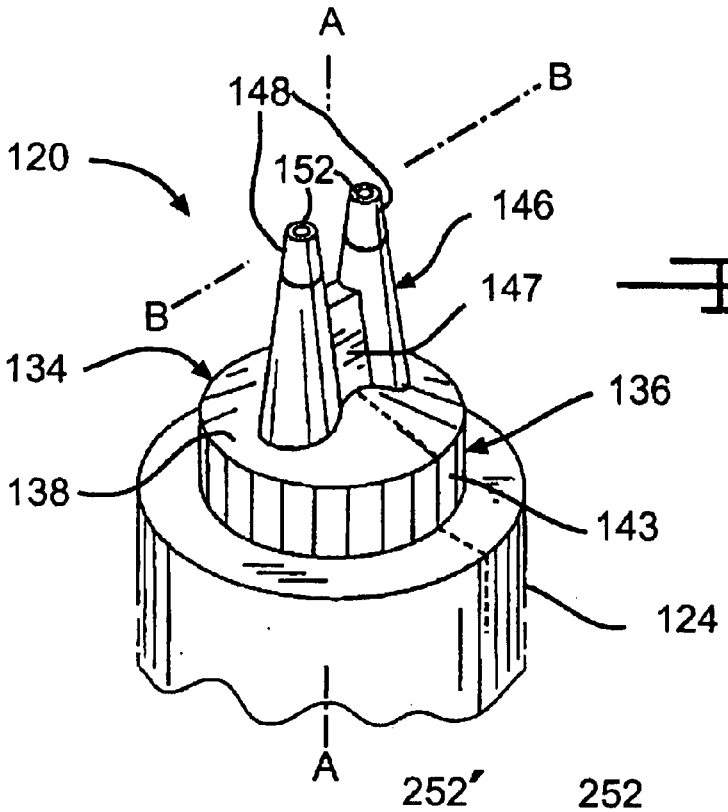
FIG. 3 is a perspective view of a cap having a pair of outlets constructed in accordance with an alternate embodiment of the invention.

Referring now to FIG. 3, an alternate embodiment is illustrated having reference numerals corresponding to like elements of FIGS. 1 and 2 incremented by 100 for the purposes of clarity and convenience. In particular, one of the tips has been removed from the cap to produce a cap 134 having a pair of tips 148 extending outwardly from the outlet housing 147 along the direction of axis B—B as described above. Accordingly, during operation, a pair of directed streams of material are emitted at a food product, thereby reducing or eliminating the need to make multiple passes. It should be appreciated that the decision to employ a cap having two or three tips may depend largely on the type of material to be applied, it being appreciated that material that is generally applied more sparingly would be better suited for the dual-outlet cap 134 as opposed to the triple-outlet cap 34, depending on the cross-sectional areas of the respective outlets. In addition, the size and shape of the food product may dictate the number of tips 148 to be used. For instance, a larger, more round food product, such as a hamburger, may be better suited for a wider three-tip design, while more narrow food, such as a hotdog, may benefit from a two-tip design.

Figure 4:
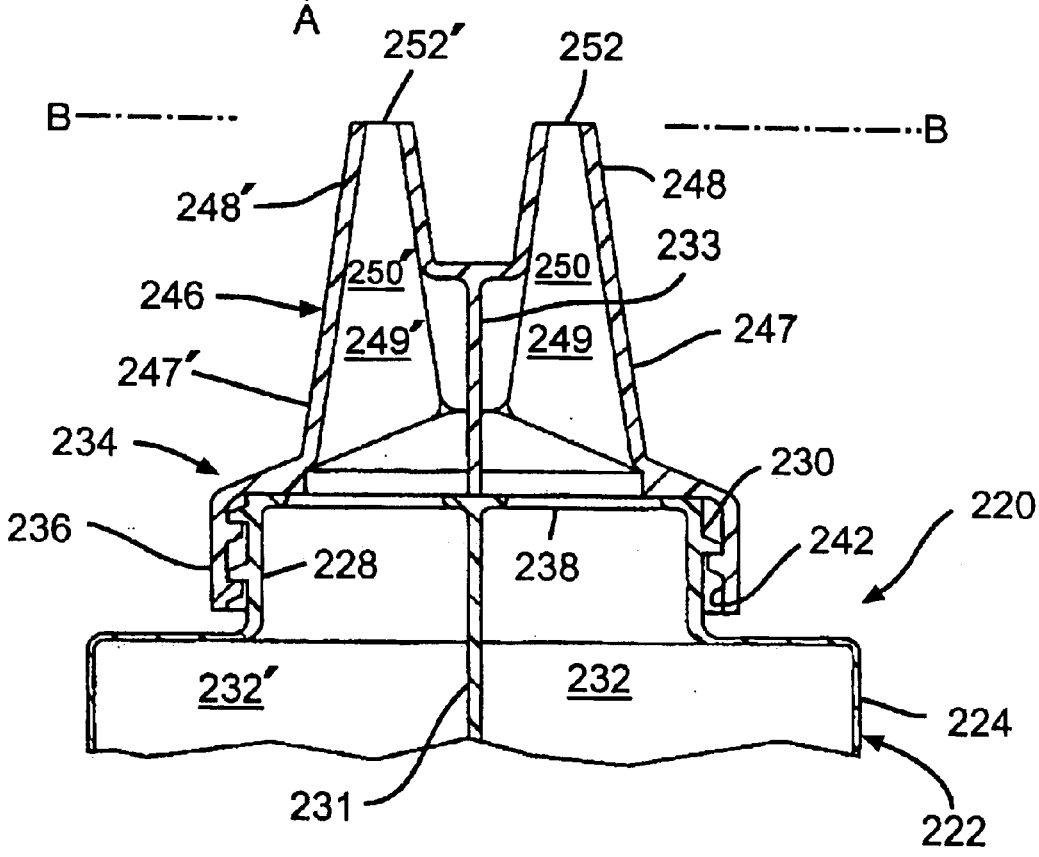
FIG. 4 is a sectional side elevation view of divided cap attached to a divided bottle in accordance with an alternate embodiment of the invention.

Referring now to FIG. 4, an alternate embodiment is illustrated having reference numerals corresponding to like elements of FIG. 3 incremented by 100 for the purposes of clarity and convenience. This embodiment recognizes that the multi-tip design of the present invention may allow a user to simultaneously dispense more than one condiment from a single container. Accordingly, squeeze bottle 220 includes a divider in the form of a wall 231 extending laterally across the container 222 along axis C—C (not shown in FIG. 4) and axially from the upper end of the neck 228 to the base of the container 222 (not shown in FIG. 4). Wall 231 is positioned so as to bisect the internal volume within container 222 to form first and second chambers 232 and 232', respectively, that have equal volume and are fluid-tight with respect to each other. Chambers 232 and 232' are thus configured to contain different materials that may be simultaneously delivered to a given food product. A cap (not shown) can be provided to selectively seal one or more of the tips 248 and 248' if desired.

The cap 234 includes a corresponding dividing wall 233 that extends along axis C—C and axially outwardly from plate 238. Wall 233 bisects the outlet assembly 246 to form a pair of internal chambers in the outlet housings 247 and 247' that define respective internal chambers 249 and 249' that are of equal volume and are fluid-tight with respect to each other. Tips 248 and 248' extend axially outwardly from housings 247 and 247' and define respective outlet channels 250 and 250' that are in fluid communication with chambers 249 and 249', respectively. Tips 248 and 248' are aligned in a direction along axis B—B as described above. A gauge (not shown) can be provided to the user for determining the proper alignment of walls 231 and 233 when attaching the cap 234 to the container 222. For instance, markings can be present on the outer surfaces of cap 234 and container 222 that, when aligned, will indicate the proper alignment of dividers 231 and 233. Preferably, threaded surfaces 230 and 242 have a large pitch to prevent the edges of dividers 231 and 233 from rubbing against each other and wearing when the cap 234 is removed from, and attached to, the container 222. A gasket (not shown) can be disposed on the mating edges of dividers 231 and 233 to seal the chambers 232 and 249, and 232' and 249' and protect the dividers.

During operation, when a user attaches cap 234 to container 222, walls 231 and 233 become aligned thereby placing outlet channels 249 and 249' in fluid communication with channels 232 and 232', respectively. A first condiment such as ketchup is disposed in chamber 232, while a second condiment such as mustard is disposed in chamber 232'. The user may thus simultaneously dispense both condiments in equal amounts using only one application of one squeeze bottle. In particular, the first condiment in chamber 232 flows only into chamber 249, and subsequently through the outlet channel 250, while the second condiment in chamber 232' flows only into chamber 249' and subsequently through the outlet channel 250'.

In some instances, it may be desirable to dispense a greater volume of one condiment than the other if, for example, one desires more ketchup than mustard. Accordingly, the embodiment illustrated in FIG. 4 can be modified to enable one to dispense more volume of one condiment than the other per pass. For example, the cross-sectional area of one of the outlets, such as outlet 252, can be enlarged to dispense a higher volume of condiment than the other outlet 252'. In order to prevent chamber 232 from becoming depleted long before the other due to the greater mass flow rate of dispensed condiment, the dividers 231 and 233 can be repositioned off-center with respect to axis A—A to define chambers 232 and 232', and chambers 249 and 249', having volumetric ratios corresponding to the ratio of respective cross-sectional areas of outlets 252 and 252' and the resulting mass flow rates.

Alternatively, instead of altering the position of Walls 231 and 233 in a two-tip design, a three-tip design such as that illustrated in FIG. 1 can be divided in a manner described above such that one-third of the container (and one corresponding tip) is dedicated to one condiment while the remaining two-thirds of the container (and two corresponding tips) are dedicated to the second condiment. Further, a container can include two dividers to define three chambers, each in fluid-tight communication with a dedicated tip, for simultaneously dispensing three condiments.

Figures 5, 6:
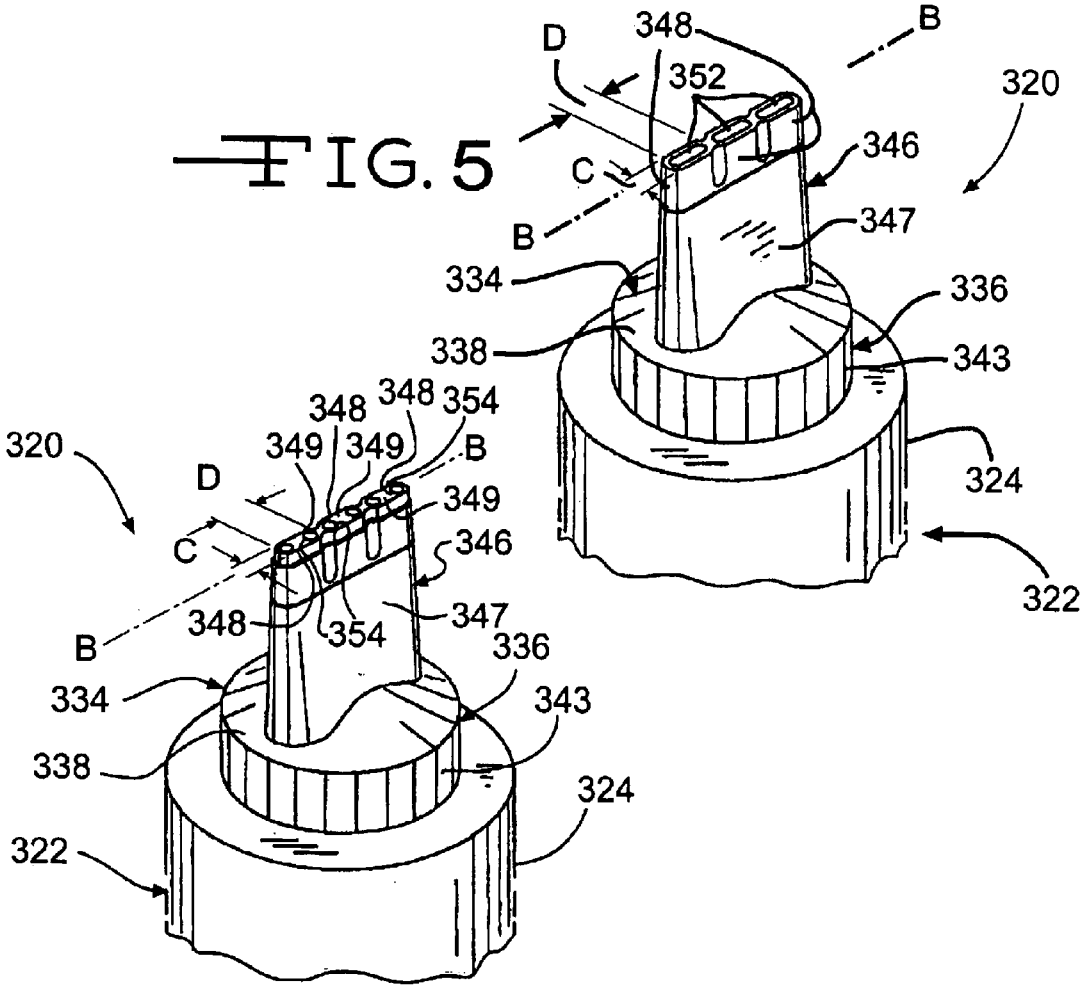
FIG. 5 is a perspective view of a cap having outlets with elongated cross sections in accordance with an alternate embodiment of the invention.
FIG. 6 is a perspective view of a cap similar to that illustrated in FIG. 5 having multiple outlets at each tip in accordance with an alternate embodiment of the invention.

Referring now to FIG. 5, an alternate embodiment of the invention is illustrated having reference numerals corresponding to like elements of the previous embodiment incremented by 100 for the purposes of clarity and convenience. In particular, cap 334 includes an outlet assembly 346 defining an outlet housing 347 that has a substantially rectangular cross-section extending axially outwardly from the plate 338. The outlet housing 347 terminates at its axially outer end at a plurality of tips 348 that extend along axis B—B. The outlets 352 of tips 348 have elongated, substantially rectangular, cross-sections whose elongated dimension D extends along axis B—B, and whose minor dimension C extends laterally (perpendicular to axis B—B). Accordingly, the bottle 320 will emit a more diffuse directed stream of condiment when applying the condiment to food product by moving the bottle laterally with respect to axis B—B, as described above. While three elongated tips 348 are illustrated, it should be appreciated that two or more such tips could be implemented in accordance with the present invention. Further, while the outlets have a rectangular cross-section, it should be appreciated that any elongated cross section, such as an oval, can also be utilized.

The elongated tips 348 can be modified as illustrated in FIG. 6, whereby a plate 349 covers the axially outer end of each outlet 348. Two apertures 354 having a circular cross section extend through plate 349 and provide multiple directed streams of condiment for each elongated tip. It should be further appreciated that any number of such apertures 354 (one or more) can be utilized.

Figure 7:
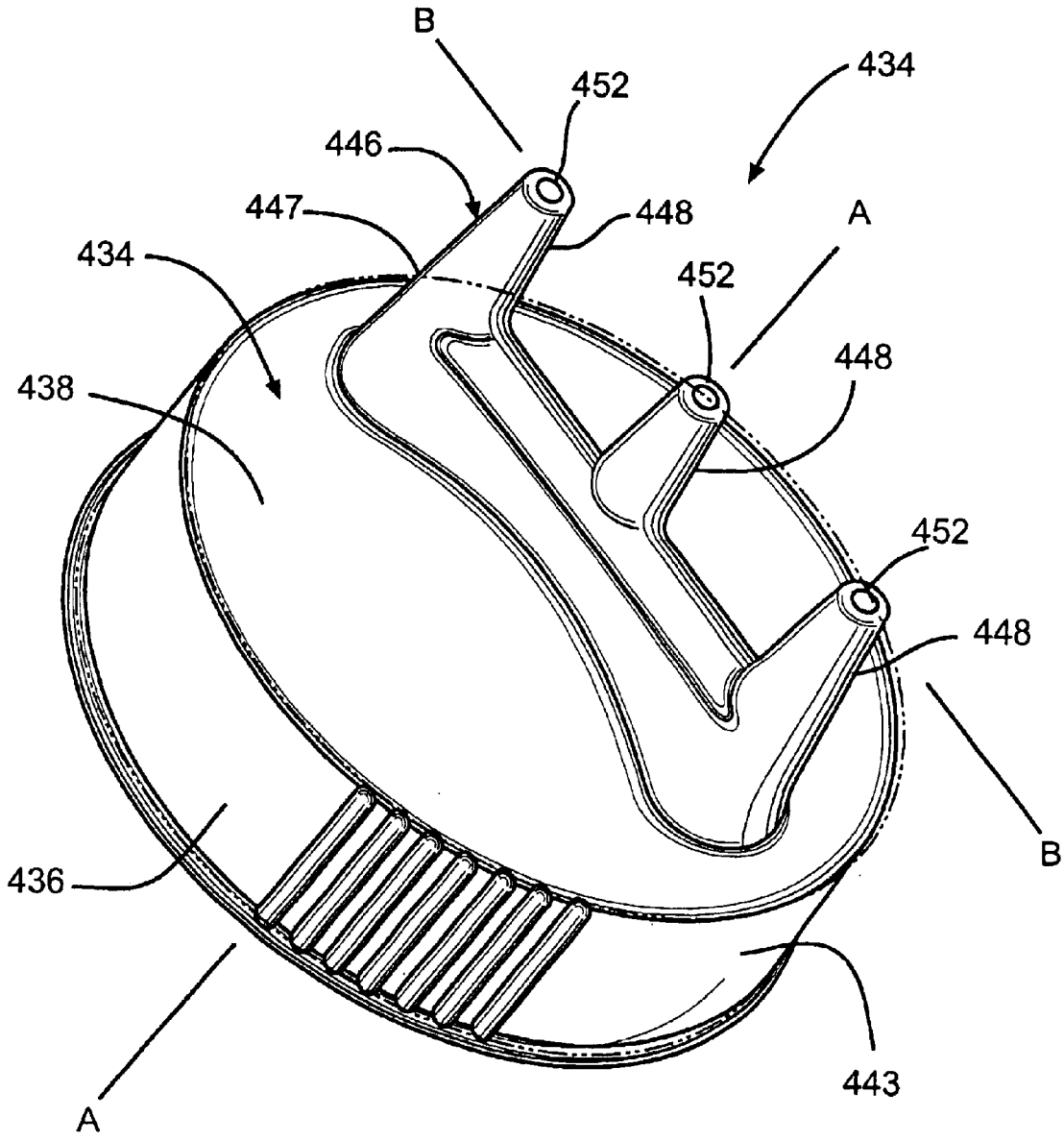
FIG. 7 is a top perspective view of a cap constructed in accordance with an alternate embodiment of the invention.
Figure 8:
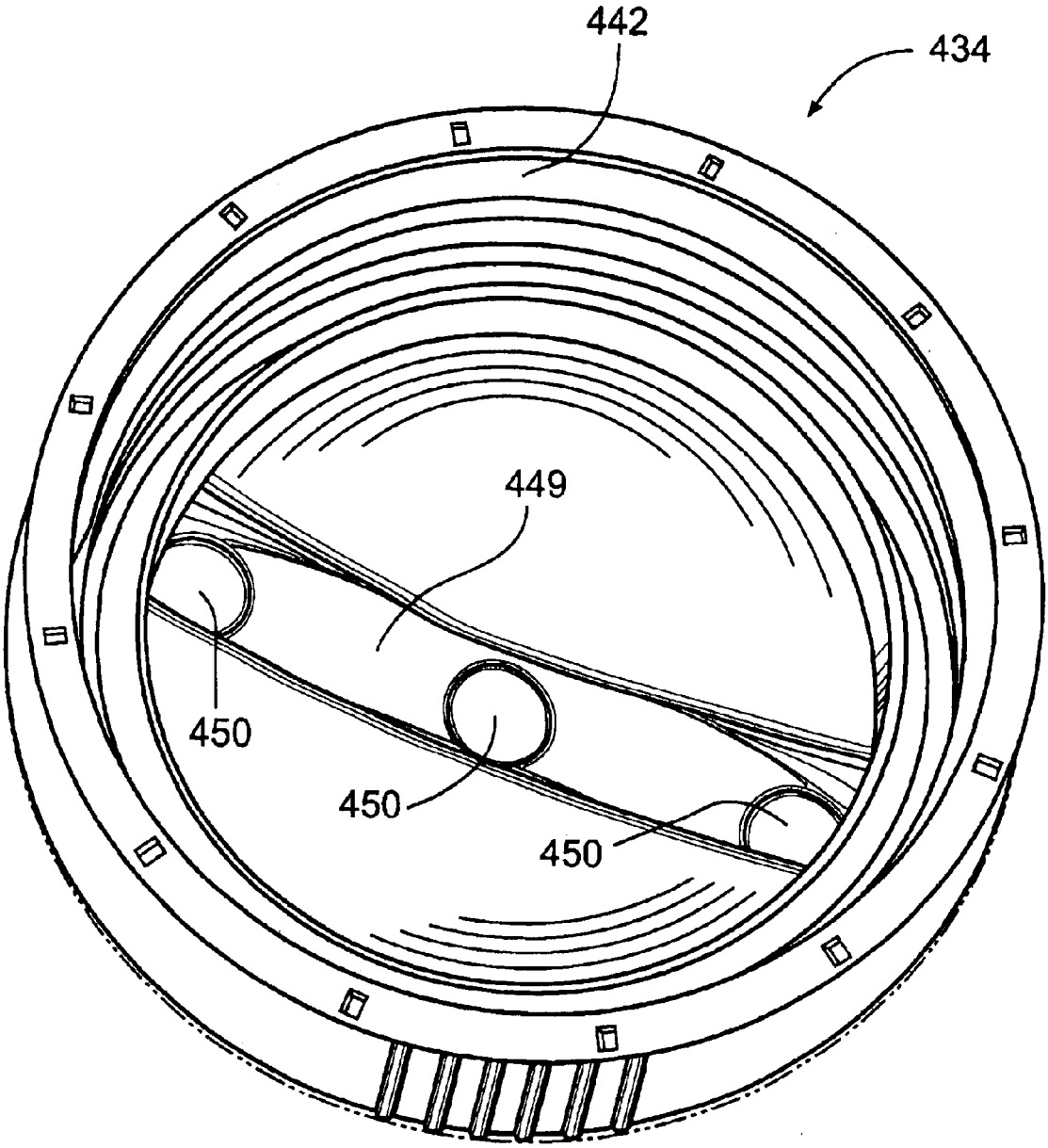
FIG. 8 is a bottom perspective view of the cap shown in FIG. 7.

Referring to FIGS. 7 and 8, an alternate embodiment is illustrated having reference numerals corresponding to like elements of FIG. 5 incremented by 100 for the purposes of clarity and convenience. The cap 434 of this embodiment can be used with one of the containers described above such as container 22. In this embodiment, the outlet housing 447 extends outwardly from the plate 438 along a direction B—B that extends transverse to axis of extension A—A. The housing 447 includes a housing interior void 449 that extends through the plate 438. Material from the container to which the cap 434 is attached enters the interior void 449 and then passes evenly through the tips 448 to the outlets 452 for placement on a food product.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A cap for dispensing a flowable liquid material disposed within an internal chamber of an axially extending container, the cap comprising:

a substantially radially extending plate having an opening extending therethrough and an axially outer surface defined by a radially outer edge;

a flange extending axially inwardly from the radially outer edge of the plate and configured to be connected to an axially outer end of the container; and an outlet assembly having an outlet housing fixedly position on the axially outer surface within the radially outer edge of the plate, the outlet housing extending axially outwardly from the plate, the outlet housing defining a housing interior void in fluid communication with the opening of the plate, the outlet assembly further having at least two frusto-conical tips fixedly positioned on the outlet housing, each tip having an interior outlet channel having an outlet and an open inlet in fluid communication with the housing interior void, whereby flowable liquid material flows from the container through the housing interior void of the outlet housing through the inlets to the interior outlet channels of the tips and evenly through the outlets of the tips.

2. The cap as recited in claim 1, wherein the tips extend axially outwardly from the outlet housing and have axially outer ends defining the outlets.

3. The cap as recited in claim 2, wherein the outlets are elongated and extend transverse to the axial direction at the axially outer end of the tips.

4. The cap as recited in claim 2, wherein the tips have large ends connected to the outlet housing, wherein the tips extend axially outwardly and have axially outer ends that terminate at the outlets.

5. The cap as recited in claim 3, wherein the tips are comprised of three frusto-conical tips.

6. The cap as recited in claim 1, wherein the outlets are aligned on the tips in a direction transverse to the axial direction.

7. The cap as recited in claim 1, wherein each outlet has a substantially circular cross section.

8. The cap as recited in claim 1, wherein each outlet has an elongated cross section, wherein the axis of elongation extends transversely with respect to the axial direction.

9. The cap as recited in claim 1, further comprising a wall extending axially inwardly from the plate and defining two separate chambers, wherein each chamber is connected to at least one outlet.

10. A bottle for dispensing a flowable liquid material, the bottle comprising:

an axially extending squeezable container having a side wall and a base at one end that collectively define an interior void for housing the flowable liquid material, the container defining a neck extending axially outwardly from an axially outer end of the container opposite the base, the neck having a threaded outer surface; and a removable cap including:

a substantially radially extending plate having an opening extending therethrough and an axially outer surface defined by a radially outer edge;

a flange extending axially inwardly from the radially outer edge of the plate and configured to be connected to an axially outer end of the container; and an outlet assembly having an outlet housing fixedly position on the axially outer surface within the radially outer edge of the plate, the outlet housing extending axially outwardly from the plate, the outlet housing defining a housing interior void in fluid communication with the opening of the plate, the outlet assembly further having at least two frusto-conical tips fixedly positioned on the outlet housing, each tip having an interior outlet channel having an outlet and an open inlet in fluid communication with the housing interior void, whereby flowable liquid material flows from the container through the housing interior void of the outlet housing through the inlets to the interior outlet channels of the tips and evenly through the outlets of the tips.

11. The cap as recited in claim 10, wherein the tips extend axially outwardly from the outlet housing and have axially outer ends defining the outlets.

12. The cap as recited in claim 11, wherein the outlets are elongated and extend transverse to the axial direction at the axially outer end of the tips.

13. The cap as recited in claim 11, wherein the outlets have a substantially circular cross section at the axially outer end of the tips.

14. The cap as recited in claim 11, wherein the tips are comprised of three frusto-conical tips.

15. The cap as recited in claim 10, wherein the outlets are aligned on the outlet housing in a direction transverse to the axial direction.

16. The cap as recited in claim 10, wherein each interior outlet channel has an axially outer end defined by a substantially circular cross-section.

17. The cap as recited in claim 10, wherein each interior outlet channel has an axially outer end defined by an elongated cross-section.

18. The cap as recited in claim 10, wherein the container further comprises at least one divider extending axially outwardly from the base to the cap that separates the internal void into at least two internal container voids, and wherein the cap further comprises at least a second divider extending axially inwardly from the plate and defining two separate cap chambers connected to at least one dedicated outlet, wherein the first and second walls are in alignment.

* * * * *